US005284745A

United States Patent [19]

Ohshima

[11] Patent Number: 5,284,745

[45] Date of Patent: Feb. 8, 1994

[54] SILVER HALIDE PHOTOGRAPHIC MATERIAL

[75] Inventor: Naoto Ohshima, Minami-ashigara, Japan

[73] Assignee: Fuji Photo Film Co., Ltd., Kanagawa, Japan

[21] Appl. No.: 961,550

[22] Filed: Oct. 15, 1992

Related U.S. Application Data

[62] Division of Ser. No. 628,150, Dec. 17, 1990, abandoned.

[30] Foreign Application Priority Data

Dec. 18, 1989 [JP] Japan ..... 1-327713

[51] Int. Cl.[5] ..... G03C 1/015

[52] U.S. Cl. ..... 430/569; 430/603; 430/605

[58] Field of Search ..... 430/567, 569, 605, 603, 430/569, 605

[56] References Cited

U.S. PATENT DOCUMENTS

| | | | |
|---|---|---|---|
| 4,820,624 | 4/1989 | Hasebe et al. | 430/567 |
| 4,865,962 | 9/1989 | Hasebe et al. | 430/567 |
| 5,137,803 | 8/1992 | Goda | 430/569 |

*Primary Examiner*—Janet C. Baxter

*Attorney, Agent, or Firm*—Burns, Doane, Swecker & Mathis

[57] ABSTRACT

There is disclosed a silver halide photographic material having a photosensitive emulsion layer on a base, comprising a high-silver-chloride silver chlorobromide emulsion which is obtained by forming, on or near the surfaces of silver halide grains, silver bromide localized phases, and then by conducting chemical sensitization and is ripened under a condition having a limited pH. The disclosure described provides a silver halide photographic material suitable for rapid processing, high in sensitivity, and good in safelight aptitude and latent-image stability.

15 Claims, No Drawings

SILVER HALIDE PHOTOGRAPHIC MATERIAL

This application is a divisional of application Ser. No. 07/628,150, filed Dec. 17, 1990, now abandoned.

FIELD OF THE INVENTION

The present invention relates to silver halide photographic materials, and more particularly to a silver halide photographic material suitable for rapid processing, high in sensitivity and contrast, excellent in safelight aptitude, and good in latent-image stability for a long period of time.

BACKGROUND OF THE INVENTION

Silver halide photographic materials currently on the market and methods for forming images using the same vary over a wide range and are used in various fields. Many of the halide compositions of silver halide emulsions used in many of these photographic materials, in particular in the case of shooting photographic materials, consist of silver bromoiodide that is mainly made up of silver bromide, for the purpose of attaining high sensitivity.

On the other hand, in products that are used in a market where there is strong demand for a large amount of prints to be finished and delivered in a short period of time, such as photographic materials for color papers, silver bromide or silver chlorobromide that is substantially free from silver iodide is used, in order to hasten the developing speed.

In recent years the demand for the improvement of rapid processibility of color papers has been increasingly strong and many studies thereof are under way. It is known that an increase in the silver chloride content of the silver halide emulsion to be used will greatly improve developing speed.

However, it is known that silver halide emulsions high in silver chloride content are attended with such defects that they hardly provide emulsions high in sensitivity and hard in gradation. Further the emulsions have a defect that reciprocity law failure, that is, the change of sensitivity and gradation due to a change in illuminance of exposure is great.

In order to overcome the above defects of silver halide emulsions high in silver chloride content, various techniques have been proposed.

JP-A ("JP-A" means unexamined published Japanese patent application) No. 26837/1989 discloses that a high-silver-chloride emulsion, whose grains have regions rich in silver bromide near the vertices gives high sensitivity and gradation and stable performance. JP-A No. 105940/1989 discloses that a high-silver-chloride emulsion having regions rich in silver bromide doped selectively with iridium constitutes an emulsion excellent in reciprocity response without damaging latent-image stability for a few hours after exposure.

Further, the inventors have continued to engage keenly in studies to increase greatly the performance of high-silver-chloride emulsions. As a result, it has become apparent that when a high-silver-chloride emulsion prepared in the above manner is used for a photographic material and the photographic material is exposed to safelight before printing, the gradation becomes inevitably softened and the latent-image stability over a longer period of time, that is, a few days after printing, is not necessarily satisfactory. If this happens the photographic material not only lacks handleability in photofinishing laboratories, the quality of the finished print will also drop.

The inventors have found that when a high-silver-chloride emulsion is sensitized with gold, latent-image stability over a longer period of time can be considerably improved. However, sometimes the use of gold sensitization brings about a softening of gradation or worsens the aging stabilities of emulsion before application and photographic material, and therefore gold sensitization could not make adequate use of the above merits of high-silver-chloride emulsions.

SUMMARY OF THE INVENTION

Therefore, the object of the present invention is to provide a silver halide photographic material suitable for rapid processing, high in sensitivity and contrast, excellent in safelight aptitude, and good in latent-image stability for a long period of time.

Other and further objects, features and advantages of the invention will appear more evident from the following description.

DETAILED DESCRIPTION OF THE INVENTION

The object of the present invention has been attained by providing a silver halide photographic material having at least one photosensitive emulsion layer on a base, which comprises, in the emulsion layer, a silver halide emulsion of silver chlorobromide, 95 mol % or more of which is made up of silver chloride, and which is substantially free from silver iodide, wherein the silver chlorobromide is obtained by forming, on and near the surfaces of silver halide grains, localized phases having a silver bromide content of at least 10 mol % and then by chemically sensitizing the surfaces, and the emulsion is ripened under a condition having a pH of 6.5 or over from the start of the formation of said localized phases to the completion of the chemical sensitization of the surfaces.

The halogen composition of silver halide grains of the present invention is made up of silver chlorobromide wherein 95 mol % or over of all silver halides constituting the silver halide grains are silver chloride, and the composition is substantially free from silver iodide. Herein "substantially free from silver iodide" means that the silver iodide content is 1.0 mol % or below. A preferable composition of the silver halide grains is silver chlorobromide wherein 98 mol % or more of all silver halides constituting the silver halide grains are silver chloride, and the composition is substantially free from silver iodide.

The silver halide grains of the present invention have localized phases having a silver bromide content of at least 10 mol %. The arrangement of such localized phases higher in silver bromide content is required to be present on and near the surfaces of the grains, in order to allow the effect of the present invention to be exhibited, and also from the standpoint, for example, of abrasion and pressure resistance and independence on processing solution compositions. Herein by "near the surfaces of the grains" is meant the position within 1/5 of the grain size of the formed silver halide grains measured from the outermost surface. In this specification and claims, "grain size" means the diameter of a ball that has the same volume as the silver halide grain. Said position is preferably within 1/10 of the grain size of the formed silver halide grains measured from the outermost surface. The most preferable arrangement of localized phases higher in silver bromide content is such that localized phases having a silver bromide content of at least 10 mol % are epitaxially grown on the corners of cubic or tetradecahedral silver chloride grains.

Although the silver bromide content of localized phases higher in silver bromide content must be over 10 mol % or over, if the silver bromide content is too excessive, in some cases unfavorable properties will be brought into the photographic material; that is, for example, desensitization will be brought about when the photographic material undergoes pressure, or the sensitivity and gradation will change greatly due to a change in the composition of the processing solution. Taking these points into account, preferably the silver bromide content of localized phases higher in silver bromide content is in the range of 10 to 60 mol %, with the most preference given to 20 to 50 mol %. The silver bromide content of localized phases higher in silver bromide content can be analyzed, for example, by the X-ray diffraction technique (described, for example, in Kozokaiseki, Shin-Jikkenkagaku Koza, Vol. 6, edited by Nihon Kagaku-Kai and published by Maruzen). It is preferable that localized phases higher in silver bromide content comprise 0.1 to 20%, more preferably 0.5 to 7%, of silver of all silver constituting silver halide grains of the present invention.

The interface between such localized phases higher in silver bromide content and other phases may constitute a clear boundary or a transition region where the halogen composition changes gradually.

In order to form such localized phases higher in silver bromide content, various techniques can be used. For instance, a soluble silver salt and a soluble halide can be reacted using the single-jet method or the double jet method to form localized phases. Further, localized phases can be formed by the conversion of previously formed silver halide grains into silver halide grains having localized phases lower in solubility product by use of the conversion process. However, with a view to allowing the effect of the present invention to be exhibited, preferably cubic or tetradecahedral silver halide host grains are mixed with silver halide fine grains that have an average grain diameter smaller than the former silver halide host grains and that are higher in silver bromide content than the former silver halide host grains, followed by ripening, thereby forming localized phases higher in silver bromide content. The average diameter of silver halide host grains is preferably 0.10 to 1.5 μm, more preferably 0.25 to 1.0 μm, and the average diameter of the silver halide fine grains is preferably 0.005 to 0.15 μm, more preferably 0.002 to 0.1 μm.

The formation of localized phases higher in silver bromide content is preferably carried out in the presence of an iridium compound. By "carrying out the formation of localized phase in the presence of an iridium compound" is meant that an iridium compound is supplied simultaneously with, before, or immediately after the supply of silver or a halogen for the formation of localized phases. When silver halide fine grains that have an average grain diameter smaller than the silver halide host grains and that are higher in silver bromide content than the host grains are mixed and then ripened to form localized phases higher in silver bromide content, most preferably an iridium compound is previously incorporated in the silver halide fine grains high in silver bromide content. Although it is possible that an iridium compound may be allowed to be present at the time of the formation of phases other than the formation of localized phases higher in silver bromide content, preferably localized phases higher in silver bromide content are formed together with at least 50% of all the iridium compound to be added, with the most preference given to at least 80% of all the iridium compound to be added.

In the present invention, after the formation of localized phases higher in silver bromide content, the surfaces are required to be chemically sensitized. As the chemical sensitization, sulfur sensitization is preferably carried out, but also preferably for example gold sensitization or reduction sensitization is additionally carried out.

Chemical sensitization with sulfur employed in the present invention is effected by using active gelatin or a compound containing sulfur capable of reacting with silver (e.g., thiosulfates, thioureas, mercapto compounds, and rhodanines). Specific examples thereof are described, for example, in U.S. Pat. Nos. 1,574,944, 2,278,947, 2,410,689, 2,728,668, and 3,656,955.

In the present invention, it is required to carry out ripening under a condition having a pH of 6.5 or over during the period from the start of the formation of localized phases higher in silver bromide content to the completion of chemical sensitization of the surfaces. If the pH is too high, since unintended fogging will be brought about in some cases, the pH is preferably 9.0 or below. For the effect of the present invention, the pH is preferably in the range of 6.8 to 8.0, most preferably in the range of 7.0 to 7.7. Ripening under a condition having a pH of 6.5 or over may be carried out only when localized phases higher in silver bromide content are formed or only when the surfaces are chemically sensitized. Ripening under a condition having a pH of 6.5 or over may be carried out during part of the period of the formation of localized phases higher in silver bromide content or during part of the period of chemical sensitization of the surfaces, or it may be carried out in parts. However, to make the effect of the present invention more remarkable, preferably the condition is kept at a pH of 6.5 or over at the time of the formation of localized phases higher in silver bromide content and at the time of chemical sensitization of the surfaces.

The silver halide grains of the present invention may be ones having, on the outer surfaces, (100) planes or (111) planes, or both, or higher planes, but preferably they are cubes or tetradecahedrons comprising mainly (100) planes. The size of the silver halide grains of the present invention may be enough if it falls within the range usually used, but preferably the average grain diameter is 0.1 to 1.5 μm. Although the grain diameter distribution may be polydisperse or monodisperse, monodisperse is preferred. Preferably the grain size distribution, which indicates the monodisperse degree, is 0.2 or below, and more preferably 0.15 or below, in terms of the ratio (s/d) of the statistical standard deviation (s) and the average grain size (d). Also preferably two or more monodisperse emulsions are used in combination.

Spectral sensitization is carried out for the purpose of providing the emulsion of each layer of the photographic material of the present invention with spectral sensitivity to a desirable wavelength region, and in the present invention it is preferably carried out by adding a dye that will absorb light in the wavelength range corresponding to the intended spectral sensitivity, that is, a spectrally sensitizing dye. As the spectrally sensitizing dye used therefor, those described, for example, by F. M. Harmer in *Heterocyclic compounds — Cyanine dyes and related compounds* (published by John Wiley & Sons [New York, London], 1964) can be mentioned. Specific compound examples and spectral sensitization methods, which are preferably used, are described in JP-A No. 215272/1987, pages 22, right upper column, to page 38.

To the silver halide emulsion of the present invention, various compounds or precursors thereof may be added for the purpose of preventing fogging in the production steps of the photographic material or during storage thereof, or for the purpose of stabilizing the photographic processing thereof. Specific examples of these compounds, which are preferably used, are described in the above JP-A No. 215272/1987, pages 39 to 72.

As the emulsion used in the present invention, use is made of the so-called surface-latent image type emulsion, wherein a latent image is formed mainly on the grain surface.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-1), (C-II), (M-I), (M-II), and (Y):

Formula (C-I)

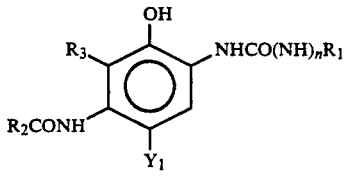

Formula (C-II)

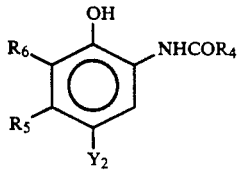

Formula (M-I)

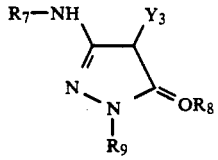

Formula (M-II)

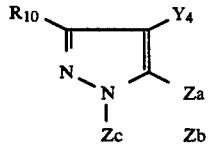

Formula (Y)

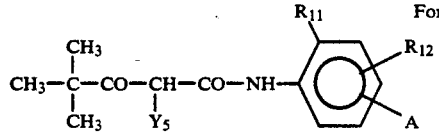

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tertbutyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za-Zb bond and the Zb-Zc bond is a double bond, and the other is a single bond. If the Zb-Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Pat. (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. A represents $—NHCOR_{13}$, $—NHSO_2—R_3$, $—SO_2NHR_{13}$, $—COOR_{13}$, or $$—SO_2\underset{\underset{R_{14}}{|}}{N}—R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.

(C-1)

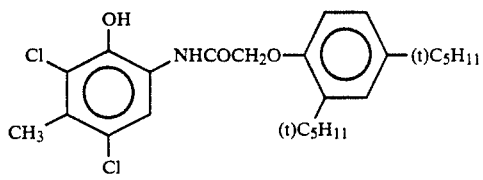

(C-2)

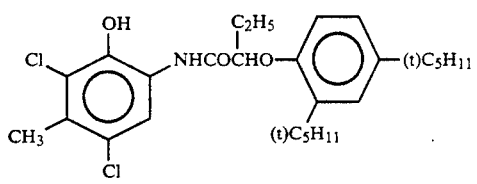

(C-3)

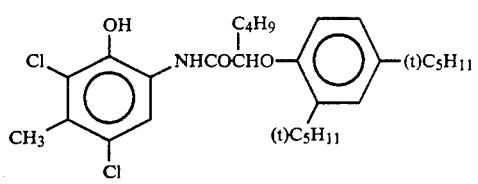

(C-4)

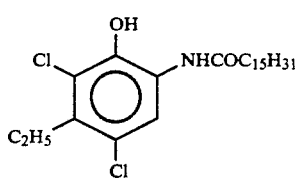

(C-5)

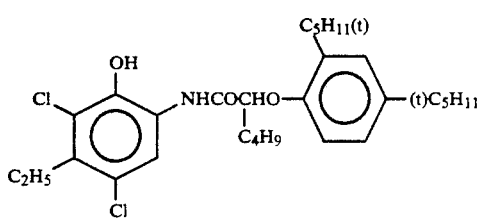

-continued
(C-6)
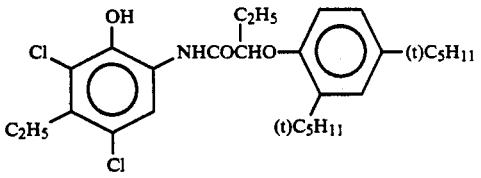
(C-7)
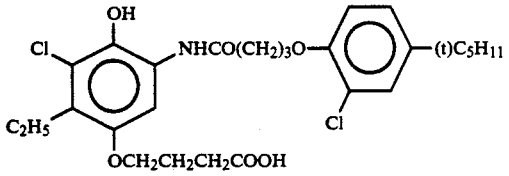
(C-8)
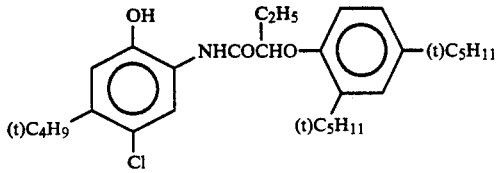
(C-9)
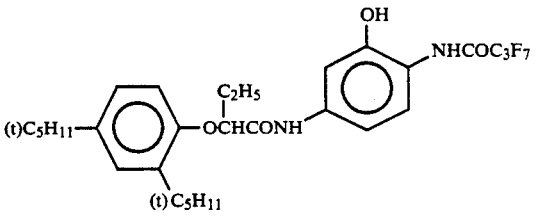
(C-10)
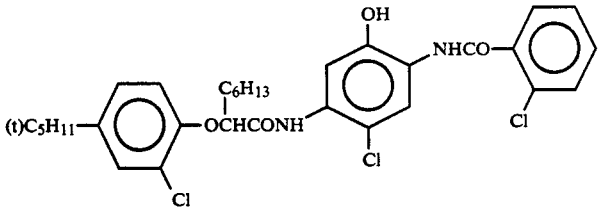
(C-11)
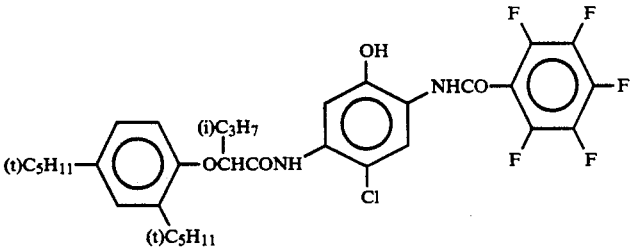
(C-12)
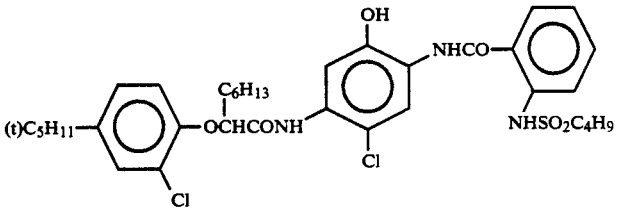

-continued
(C-13)
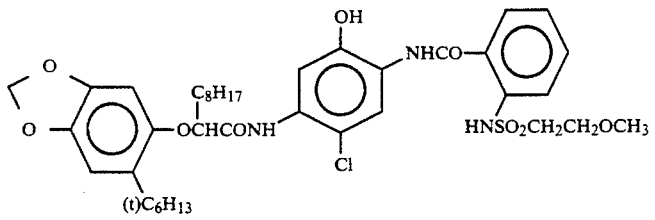
(C-14)
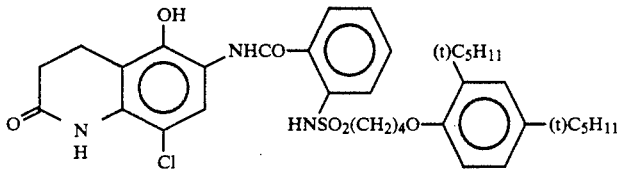
(C-15)
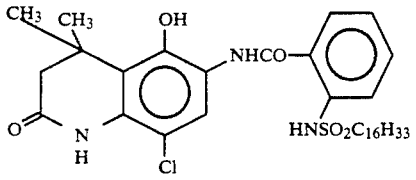
(C-16)
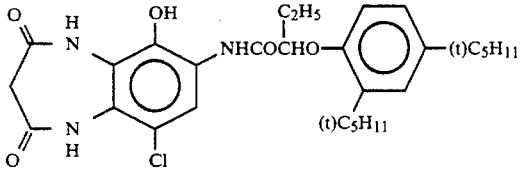
(C-17)
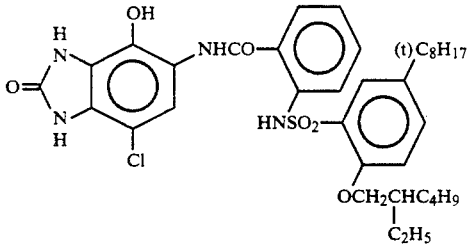
(C-18)
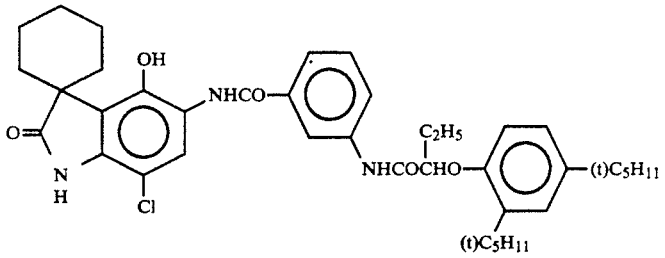
(C-19)
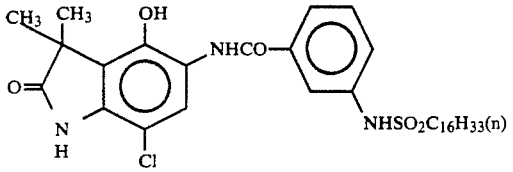

-continued
(C-20)
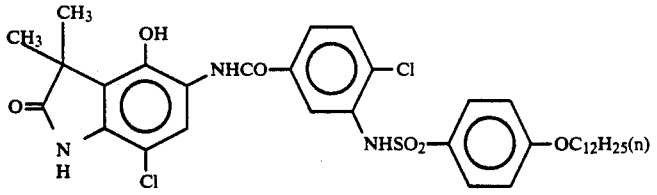
(C-21)
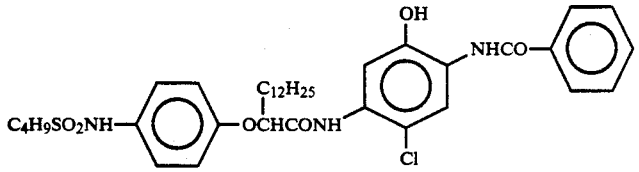
(C-22)
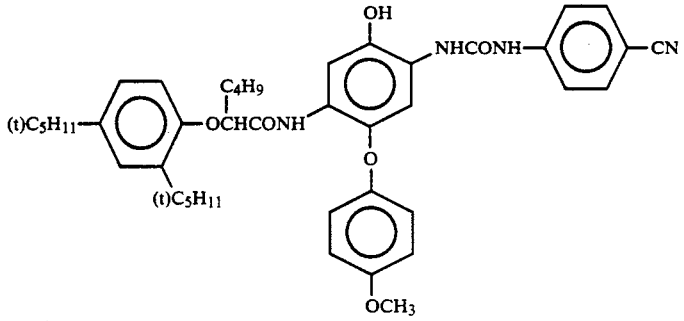
(M-1)
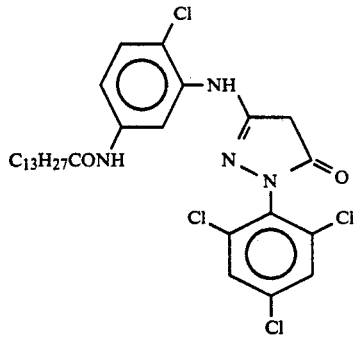
(M-2)
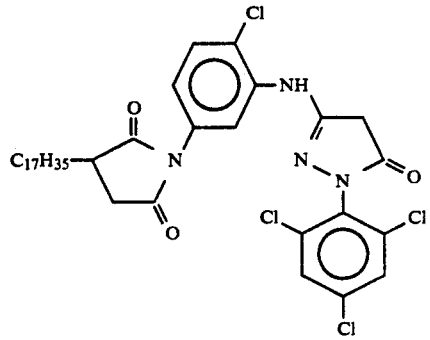

-continued
(M-3)
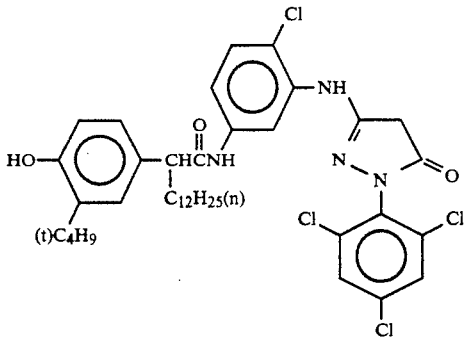
(M-4)
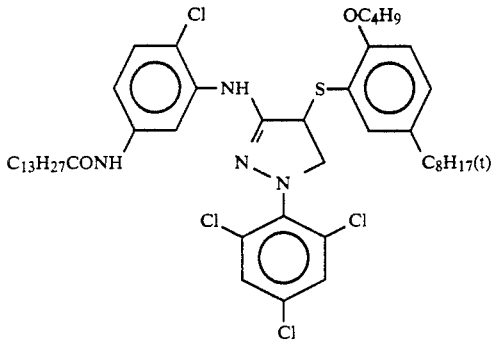
(M-5)
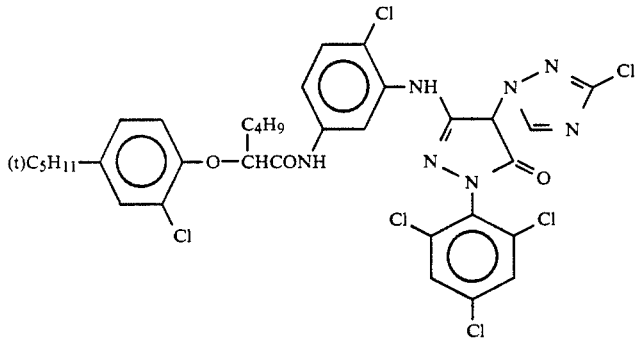
(M-6)
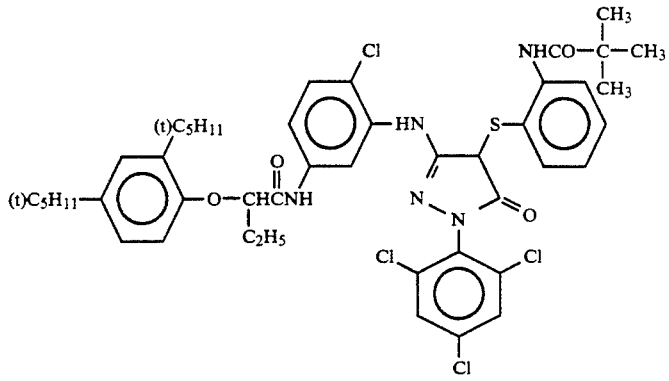

-continued
(M-7)
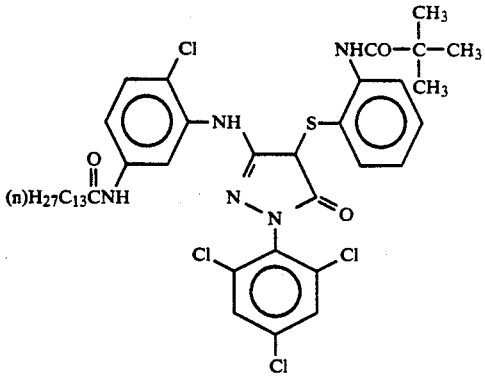
(M-8)
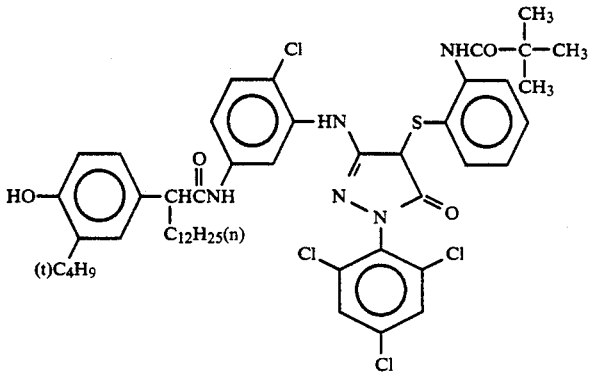

| Compound | $R_{10}$ | $R_{15}$ | $Y_4$ |
|---|---|---|---|
| | | 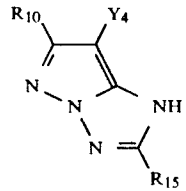 | |
| M-9 | $CH_3$— | 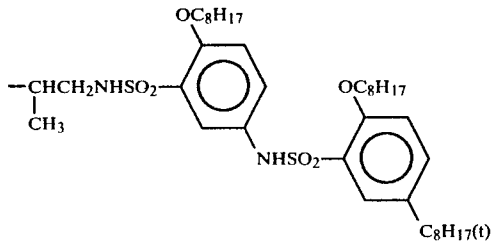 | Cl |
| M-10 | The same as the above | 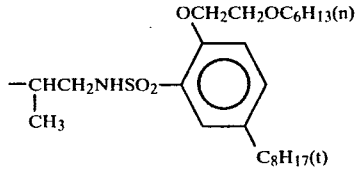 | The same as the above |
| M-11 | $(CH_3)_3C$— | 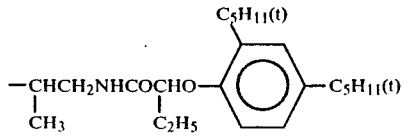 | 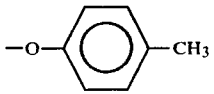 |
| M-12 | 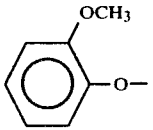 | 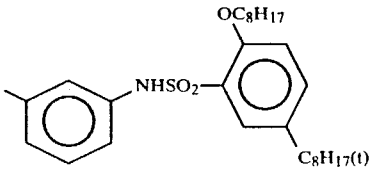 | 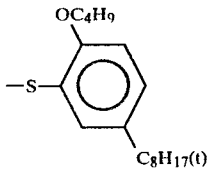 |

-continued
| Compound | $R_{10}$ | $R_{15}$ | $Y_4$ |
|---|---|---|---|
| M-13 | $CH_3$— | 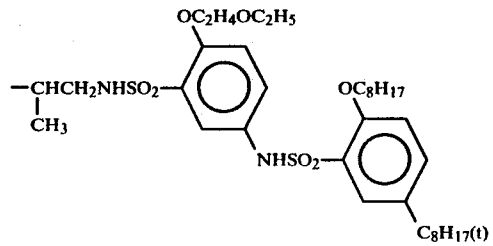 | Cl |
| M-14 | The same as the above | 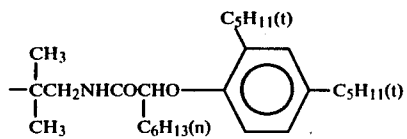 | The same as the above |
| M-15 | The same as the above | 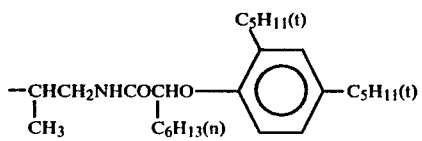 | The same as the above |
| M-16 | The same as the above | 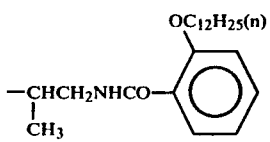 | The same as the above |
| M-17 | The same as the above | 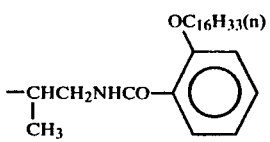 | The same as the above |

-continued
| Compound | $R_{10}$ | $R_{15}$ | $Y_4$ |
|---|---|---|---|
| M-18 | 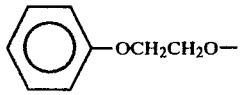 | 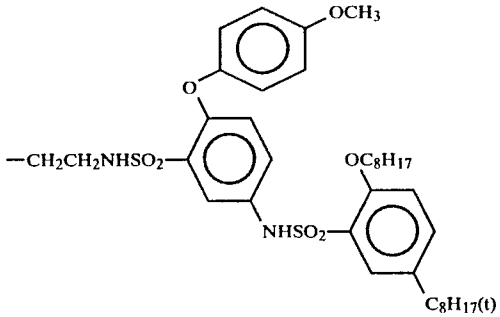 | 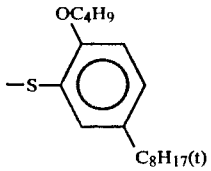 |
| M-19 | $CH_3CH_2O$— | The same as the above | The same as the above |
| M-20 | 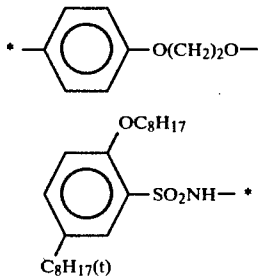 | 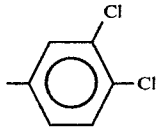 | 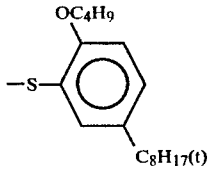 |
| M-21 | 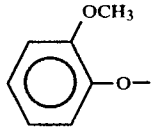 | 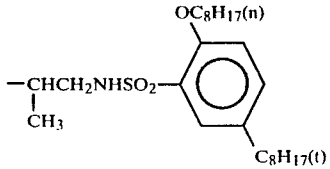 | Cl |
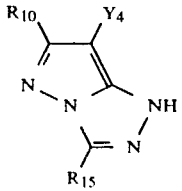

-continued
| Compound | $R_{10}$ | $R_{15}$ | $Y_4$ |
|---|---|---|---|
| M-22 | $CH_3$— | 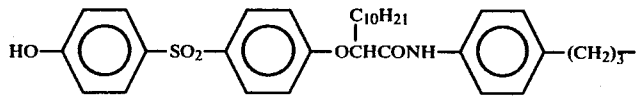 | Cl |
| M-23 | The same as the above | 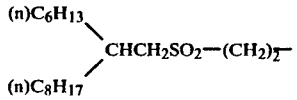 | The same as the above |
| M-24 | 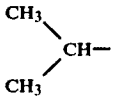 | 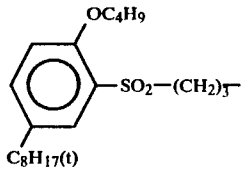 | The same as the above |
| M-25 | 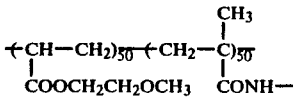 | 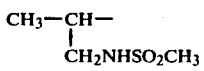 | The same as the above |
| M-26 | 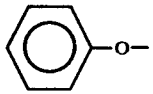 | 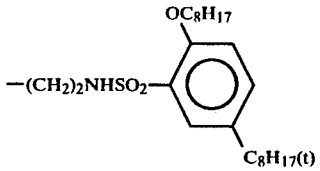 | The same as the above |
| M-27 | $CH_3$— | 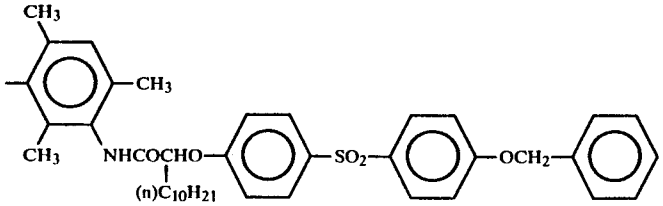 | Cl |

-continued
| Compound | $R_{10}$ | $R_{15}$ | $Y_4$ |
|---|---|---|---|
| M-28 | $(CH_3)_3C$— | 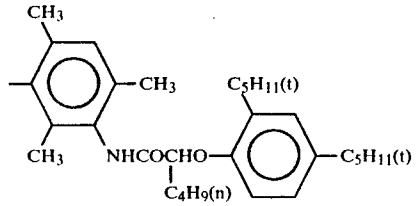 | The same as the above |
| M-29 | 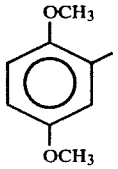 | 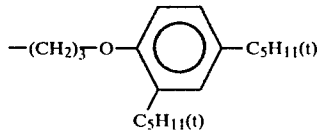 | The same as the above |
| M-30 | $CH_3$— | 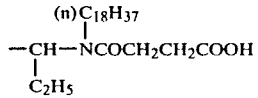 | The same as the above |

(Y-1)
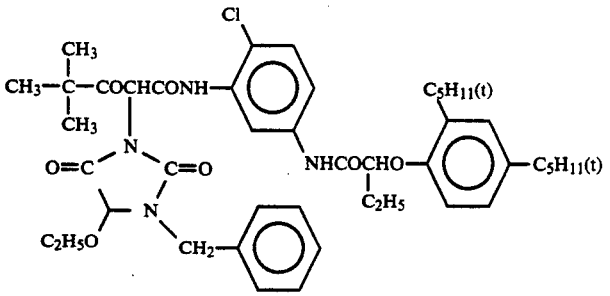
(Y-2)
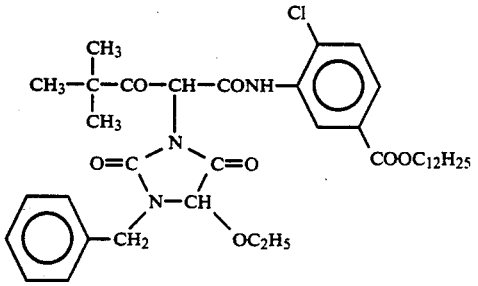
(Y-3)
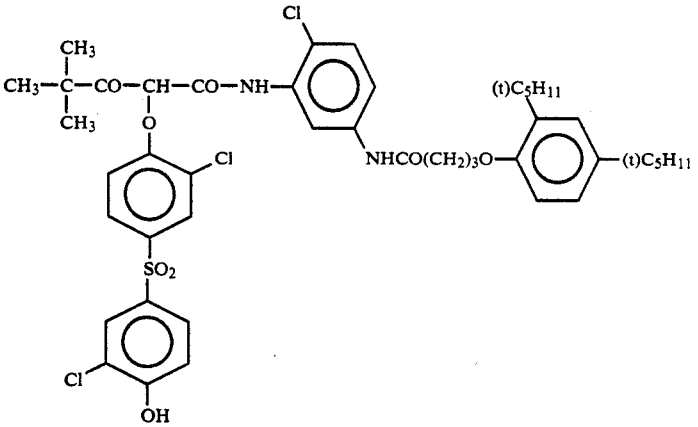
(Y-4)
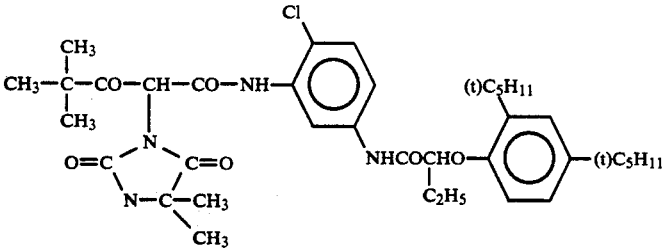
(Y-5)
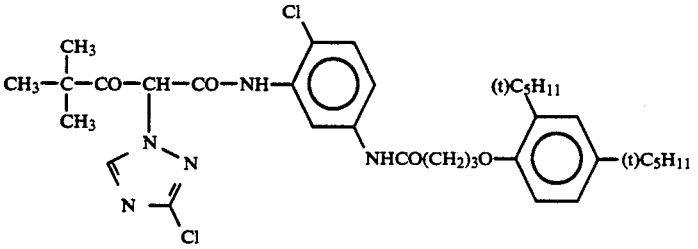

-continued (Y-6)

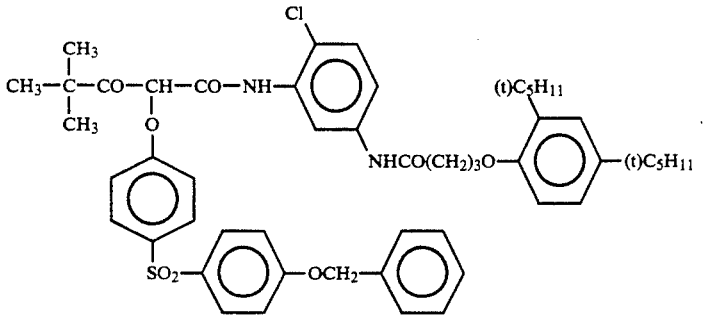

(Y-7)

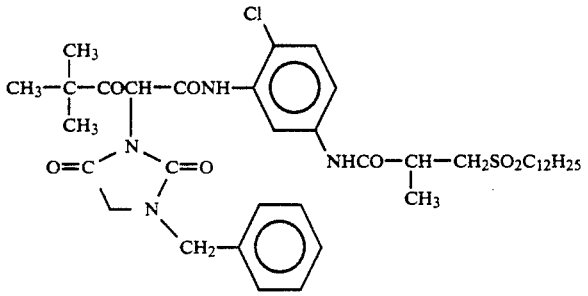

(Y-8)

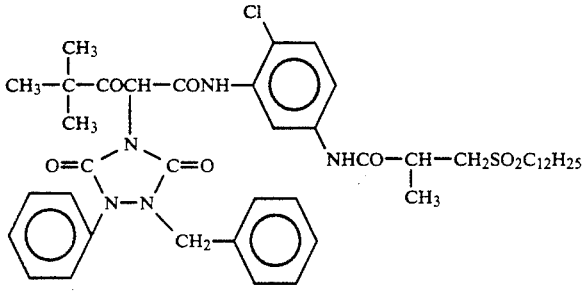

(Y-9)

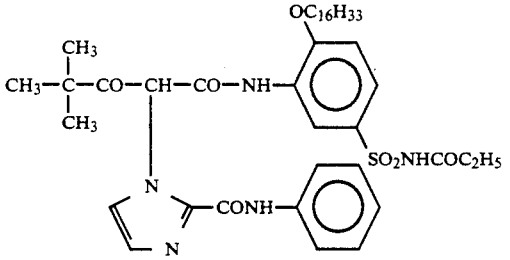

The color photographic material of the present invention may be made by applying on a base at least one blue-sensitive silver halide emulsion layer, at least one green-sensitive silver halide emulsion layer, and at least one red-sensitive silver halide emulsion layer. Generally, in color papers, it is common that the emulsion layers are applied in the above-stated order, although the order may be different therefrom. An infrared-sensitive silver halide emulsion layer can be used instead of at least one of the above emulsion layers. By incorporating, into the photosensitive emulsion layers, silver halide emulsions sensitive to respective wavelength regions, and dyes complementary to the lights to which they are sensitive, that is, so-called color couplers for forming yellow for blue, magenta for green, and cyan for red, color reproduction of the subtractive color process can be effected. However, the photosensitive layers and the color-forming hues of the couplers may be constituted not to have the above correspondence.

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A'), (B'), (C'), (D'), or (E') is preferably used.

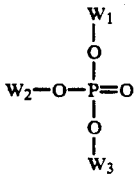
Formula (A')

$W_1-COO-W_2$ Formula (B')

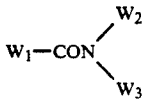
Formula (C')

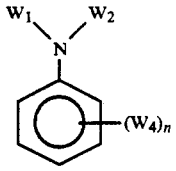
Formula (D')

$W_1-O-W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or S-$W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic antifading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Pat. No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Pat. No. 2,066,975, JP-A No. 10539/1984, and JP-B No. 19765/1982; hindered phenols are described, for example, in U.S. Pat. Nos. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Pat. Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Pat. No. 2,027,731(A). To attain the purpose, these compounds can be added to the photosensitive layers by coemulsifying them with the corresponding couplers, with the amount of each compound being generally 5 to 100 wt % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0 /mol·sec to $1\times10^{-5}$ /mol·sec. The second-order reaction- specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

$$R_1 - (A_1)_n - X \qquad \text{Formula (FI)}$$

$$R_2-\underset{\underset{B_1}{|}}{C}=Y \qquad \text{Formula (FII)}$$

wherein $R_1$ and $R_2$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_1$ and X, or Y and $R_2$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R_3 - Z \qquad \text{Formula (GI)}$$

wherein $R_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese patent application no. 136724/1988, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6$ $\mu m$, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(Ri-R)^2}{n-1}} \Big/ \frac{\sum_{i=1}^{n} Ri}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the present color photographic material is color-developed, bleach-fixed, and washed (or stabilized). The bleach and the fixing may not be effected in the single bath described above, but may be effected separately.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl)amino]-aniline
D-6: 4-amino-3-methyl-N-ethyl-N-[β-(methanesulfonamido)ethyl]-aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0 \times 10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0 \times 10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 14655/1988, 5355/1988, 43140/1988, 56654/1988, 58346/1988, 13138/1988, 146041/1988, 170642/1988, 11657/1988, and 44656/1988, U.S. Pat. Nos. 3,615,503 and 2,494,903, JP-A No. 143020/1977, and JP-B 30496/1973.

As the other preservative, various metals described, for example, in JP-A Nos. 44148/1982 and 53749/1982, salicylic acids described, for example, in JP-A No. 180588/1984, alkanolamines described, for example, in JP-A No. 3532/1979, polyethyleneimines described, for example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese patent application nos. 255270/1987, 9713/1988, 9714/1988, and 11300/1988.

The use of amines in combination with the above-mentioned hydroxylamine derivatives or hydrazine derivatives is preferable in view of stability improvement of the color developer resulting its stability improvement during the continuous processing.

As the example of the above-mentioned amines cyclic amines described, for example, in JP-A No. 239447/1988, amines described, for example, in JP-A No. 128340/1988, and amines described, for example, in Japanese patent application nos. 9713/1988 and 11300/1988.

In the present invention, it is preferable that the color developer contains chloride ions in an amount of $3.5\times10^{-2}$ to $1.5\times10^{-1}$ mol/l, more preferably $4\times10^{-2}$ to $1\times10^{-1}$ mol/l. If the concentration of ions exceeds $1.5\times10^{-1}$ mol/l, it is not preferable that the development is made disadvantageously slow, not leading to attainment of the objects of the present invention such as rapid processing and high density. On the other hand, if the concentration of chloride ions is less than $3.5\times10^{-2}$ mol/l, fogging is not prevented.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10^{-3}$ mol/l, the development is made slow, the maximum density and the sensitivity are made low, and if the concentration of bromide ions is less than $3.0\times10^{-5}$ mol/l, fogging is not prevented sufficiently.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause fogging), and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l, and particularly preferably 0.1 to 0.4 mol/l.

In addition to the color developer can be added various chelating agents to prevent calcium or magnesium from precipitating or to improve the stability of the color developer. As the example of chelating agents can be mentioned nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20° to 50° C., and preferably 30° to 40° C. The processing time is 20 sec to 5 min, and preferably 30 sec to 2 min. Although it is preferable that the replenishing amount is as small as possible, it is suitable that the replenishing amount is 20 to 600 ml, preferably 50 to 300 ml, more preferably 60 to 200 ml, and most preferably 60 to 150 ml, per square meter of the photographic material.

The desilvering step in the present invention will now be described. Generally the desilvering step may comprise, for example, any of the following steps: a bleaching step — a fixing step; a fixing step — a bleach-fixing step; a bleaching step — a bleach-fixing step; and a bleach-fixing step.

Next, the bleaching solution, the bleach-fixing solution, and the fixing solution that are used in the present invention will be described.

As the bleaching agent used in the bleaching solution or the bleach-fixing solution used in present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Pat. No. 1,290,812, JP-A No. 95630/1978, and Research Disclosure No. 17129 (July 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8- octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku* (1986) published by Sankyo-Shuppan, *Biseibutsu no Genkin, Sakkin, Bobai Gijutsu* (1982), edited by Eiseigijutsu-kai published by Kogyo-Gijutsu kai, and in *Bokin Bobai-zai Jiten* (1986) edited by Nihon Bokin Bobai-gakkai, can be used.

Further, the washing water can contain surface-active agents as a water draining agent, and chelating agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

Further, chelating agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as a washing solution or a stabilizing solution, used after the desilverization.

The pH of the washing step or a stabilizing step is preferably 4 to 10, more preferably 5 to 8. The temperature will vary depending, for example, on the application and the characteristics of the photographic material, and it generally will be 15° to 45° C., and preferably 20° to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge, and the handleability.

According to the present invention an excellent silver halide photographic material can be provided, that is excellent in rapid processability, that can attain high sensitivity and high contrast, and wherein the fluctuation of sensitivity due to a change of temperature or illuminance at the time of exposure is less, and desensitization that can be caused by application of pressure is less.

According to the present invention, a silver halide photographic material suitable of rapid processing, high in sensitivity and contrast, excellent in safelight aptitude, and good in latent-image stability for a long period of time can be provided.

Next, the present invention will be described in detail in accordance with example, but the invention is not limited by them.

EXAMPLE 1

After 32 g of lime-treated gelatin was added to 1000 ml of distilled water and dissolved therein at 40° C., 3.3 g of sodium chloride was added to the solution and the temperature was elevated to 60° C. 1.8 ml of N,N'-dimethylimidazolidine-2-thione (1% aqueous solution) was added to the resulting solution. Then a solution of 32.0 g of silver nitrate in 200 ml of distilled water and a solution of 11.0 g of sodium chloride in 200 ml of distilled water were added to and mixed with the solution over 14 min with the temperature kept at 60° C. Further, a solution of 128.0 g of silver nitrate in 560 ml of distilled water and a solution of 44.0 g of sodium chloride in 560 ml of distilled water were added and mixed with the obtained solution over 40 min with the temperature kept at 60° C. After desalting and washing with water at 40° C. were effected, 90.0 g of lime-treated gelatin was added thereto, and with sodium chloride and sodium hydroxide the pAg and the pH were respectively adjusted to 7.5 and 6.2. Then, after a red-sensitive sensitizing dye (S-1) was added in an amount of $8\times10^{-5}$ mol per mol of the silver halide, sulfur sensitization with triethyl thiourea was effected optimally at 50° C. The thus obtained silver chloride emulsion was designated as emulsion A.

By the same procedure for the preparation of emulsion A, except that after the pH was adjusted to 7.2, the sensitization was optimized, a silver chloride emulsion was prepared and was designated as emulsion B.

By the same procedure for the preparation of emulsion A, except that before the sulfur sensitization, a silver bromide ultrafine grain (having a grain size of 0.05 μm) was added such that 0.8 mol % of silver bromide might be contained for the silver chloride, and after ripening was effected for 15 min, the sensitization was optimized, a silver chlorobromide emulsion was prepared and was designated as emulsion C.

By the same procedure for the preparation of emulsion C, except that before the addition of the silver bromide ultrafine grain, the pH was adjusted to 6.7 and then the sensitization was optimized, a silver chlorobromide emulsion was prepared and was designated as emulsion D.

By the same procedure for the preparation of emulsion D, except that before the addition of the silver bromide ultrafine grains, the pH was adjusted to 7.2 and then the sensitization was optimized, a silver chlorobromide emulsion was prepared and was designated as emulsion E.

By the same procedure for the preparation of emulsion E, except that before the addition of the silver bromide ultrafine grain, the pH was adjusted to 7.8 and then the sensitization was optimized, a silver chlorobromide emulsion was prepared and was designated as emulsion F.

With respect to the thus prepared six emulsions A to F, the shape, size, and size distribution of the grains were determined from electromicrographs. The grain size was represented by the average value of the diameters of circles equivalent to the projected areas of the grains, and the grain size distribution was given by the value obtained by dividing the standard deviation of the grain diameters by the average grain size. All emulsions A to F were cubic grains of grain size 0.56 μm and grain size distribution 0.09.

Electromicrographs of emulsions C, D, E, and F, wherein silver chlorobromide ultrafine grains had been added, showed that the cubes had corners sharper than those of emulsions A and B wherein silver bromide ultrafine grains had not been added. X-ray diffractions of emulsions C, D, E, and F showed weak diffraction at parts wherein the silver bromide content corresponded to 10 to 50 mol %. From the above it can be said that emulsions C, D, E, and F are ones wherein localized phases having a silver bromide content of 10 to 50 mol % are grown epitaxially on the corners of cubic silver chloride grains.

Red-sensitive sensitizing dye (S-1)

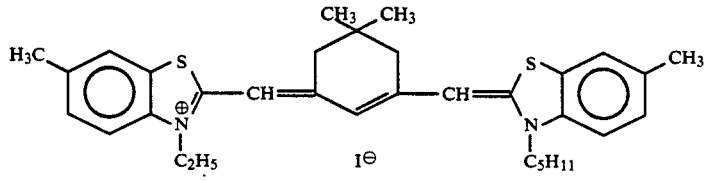

A multilayer photographic material was prepared by multi-coatings composed of the following layer composition on a two-side polyethylene laminated paper support. Coating solutions were prepared as follows:

Preparation of the first layer coating solution

To a mixture of 19.1 g of yellow coupler (ExY), 4.4 g of image-dye stabilizer (Cpd-1) and 0.7 g of image-dye stabilizer (Cpd-7), 27.2 ml of ethyl acetate and 8.2 g of solvent (Solv-1) were added and dissolved. The resulting solution was dispersed and emulsified in 185 ml of 10% aqueous gelatin solution containing 8 ml of sodium dodecylbenzenesulfonate. Separately another emulsion was prepared by adding two kinds of blue-sensitive sensitizing dye, shown below, to a blend of silver chlorobromide emulsions (cubic grains, 3:7 (silver mol ratio) blend of grains having 0.88 μm and 0.7 μm of average grain size, and 0.08 and 0.10 of deviation coefficient of grain size distribution, respectively, each in which 0.2 mol % of silver bromide was located at the surface of grains) in such amounts that each dye corresponds $2.0\times10^{-4}$ mol to the large size emulsion and $2.5\times10^{-4}$ mol to the small size emulsion, per mol of silver, and then sulfur-sensitized. The thus-prepared emulsion and the above-obtained emulsified dispersion were mixed together and dissolved to give the composition shown below, thereby preparing the first layer coating solution.

Coating solutions for the second to seventh layers were also prepared in the same manner as the first-layer coating solution. As a gelatin hardener for the respective layers, 1-hydroxy-3,5-dichloro-s-treazine sodium salt was used.

As spectral-sensitizing dyes for the respective layers, the following compounds were used:

Blue-sensitive emulsion layer:

-continued

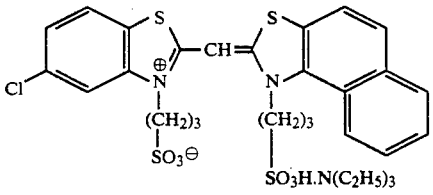

and

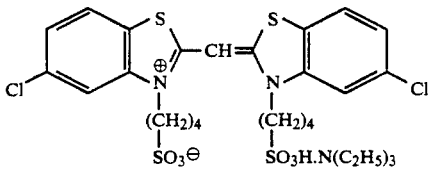

(each $2.0 \times 10^{-4}$ mol to the large size emulsion and $2.5 \times 10^{-4}$ mol the the small size emulsion, per mol of silver halide.)

Green-sensitive emulsion layer:

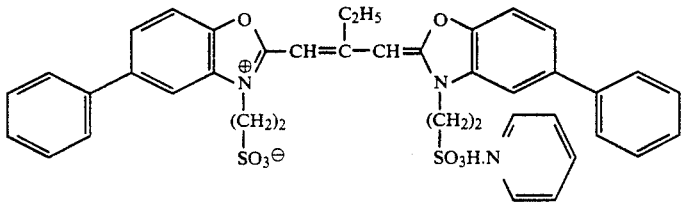

($4.0 \times 10^{-4}$ mol to the large size emulsion and $5.6 \times 10^{-4}$ mol th the small size emulsion, per mol of silver halide)

and

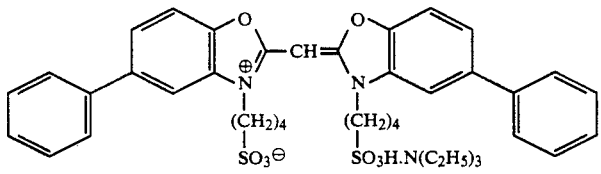

($7.0 \times 10^{-5}$ mol to the large size emulsion and $1.0 \times 10^{-5}$ mol the the small size emulsion, per mol of silver halide)

To the red-sensitive emulsion layer, the following compound was added in an amount of $2.6 \times 10^{-3}$ mol per mol of silver halide:

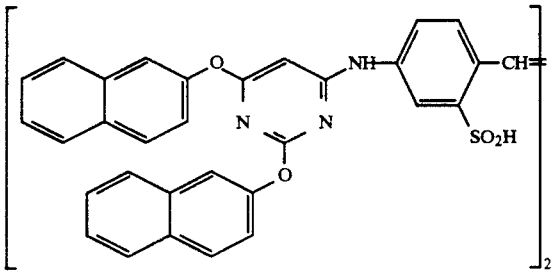

Further, 1-(5-methylureidophenyl)-5-mercaptotetrazole was added to the blue-sensitive emulsion layer, the green-sensitive emulsion layer, and the red-sensitive emulsion layer in amount of $8.5 \times 10^{-5}$ mol, $7.7 \times 10^{-4}$ mol, and $2.5 \times 10^{-4}$ mol, per mol of silver halide, respectively.

Further, to the blue-sensitive emulsion layer and the green-sensitive layer 4-hydroxy-6-methyl-1,3,3a,7-tetrazaubdebe was added in amounts of $1.0 \times 10^{-4}$ mol and $2.0 \times 10^{-4}$ mol per mol of silver halide, respectively.

The following dyes were added to the emulsion were to prevent irradiation.

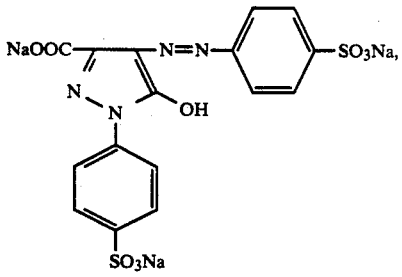

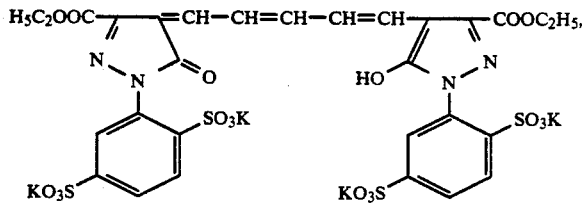

and

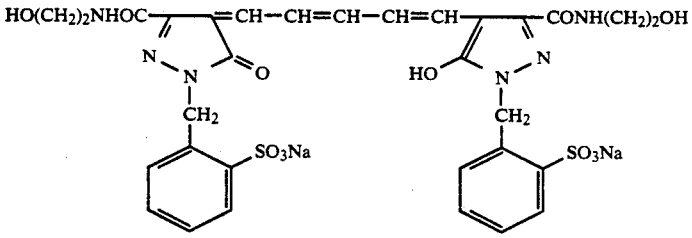

Composition of Layers

The composition of each layer is shown below. The figures represent coating amount (g/m$^2$). The coating amount of each silver halide emulsion is given in terms of silver.

Supporting Base

Paper laminated on both sides with polyethylene (a white pigment, $TiO_2$, and a bluish dye, ultramarine, were included in the first layer side of the polyethylene-laminated film)

| | |
|---|---|
| First Layer (Blue-sensitive emulsion layer): | |
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |
| Second Layer (Color-mix preventing layer): | |
| Gelatin | 0.99 |
| Color mix inhibitor (Cpd-5) | 0.08 |
| Solvent (Solv-1) | 0.16 |
| Solvent (Solv-4) | 0.08 |
| Third Layer (Green-sensitive emulsion layer): | |
| Silver chlorobromide emulsions (cubic grains, 1:3 (Ag mol ratio) blend of grains having 0.55 μm and 0.39 μm of average grain size, and 0.10 and 0.08 of deviation coefficient of grain size distribution, respectively, each in which 0.8 mol % of AgBr was located at the surface of grains) | 0.12 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |
| Fourth Layer (Ultraviolet absorbing layer): | |
| Gelatin | 1.58 |
| Ultraviolet absorber (UV-1) | 0.47 |
| Color-mix inhibitor (Cpd-5) | 0.05 |
| Solvent (Solv-5) | 0.24 |
| Fifth Layer (Red-sensitive emulsion layer): | |
| Silver chloride emulsion A | 0.23 |
| Gelatin | 1.34 |

-continued

| | |
|---|---|
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |
| Sixth layer (Ultraviolet ray absorbing layer): | |
| Gelatin | 0.53 |
| Ultraviolet absorber (UV-1) | 0.16 |
| Color-mix inhibitor (Cpd-5) | 0.02 |
| Solvent (Solv-5) | 0.08 |
| Seventh layer (Protective layer): | |
| Gelatin | 1.33 |
| Acryl-modified copolymer of polyvinyl alcohol (modification degree: 17%) | 0.17 |
| Liquid paraffin | 0.03 |

Compounds used are as follows:

(ExY) Yellow coupler

Mixture (1:1 in molar ratio) of

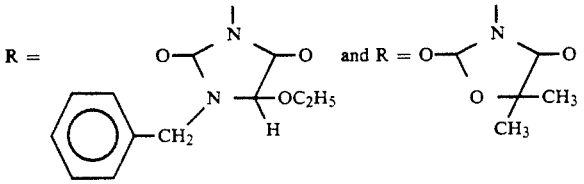

of the following formula

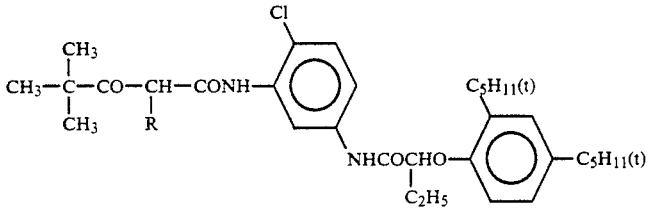

(ExM) Magenta coupler

Mixture (1:1 in molar ratio) of

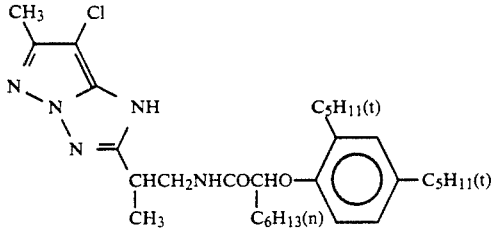

and

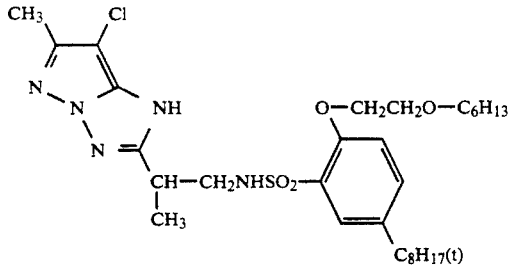

(ExC) Cyan coupler

Mixture (2:4:4 in weight ratio) of R = $C_2H_5$ and $C_4H_9$ of

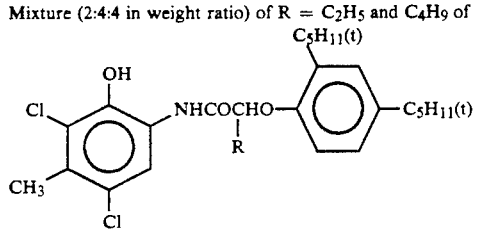

and

-continued
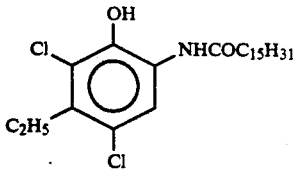
(Cpd-1) Image-dye stabilizer
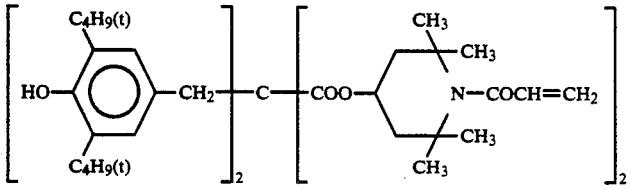
(Cpd-2) Image-dye stabilizer
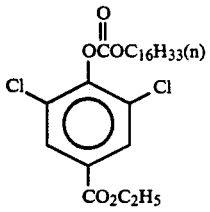
(Cpd-3) Image-dye stabilizer
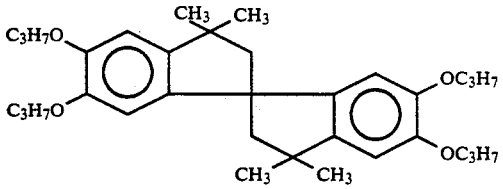
(Cpd-4) Image-dye stabilizer
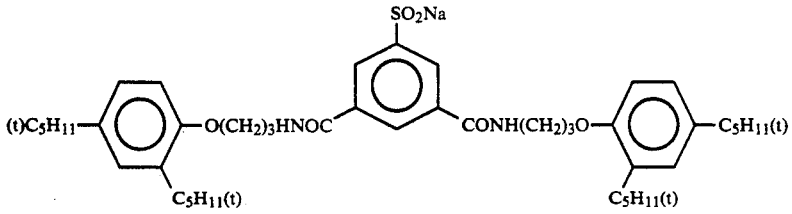
(Cpd-5) Color-mix inhibitor
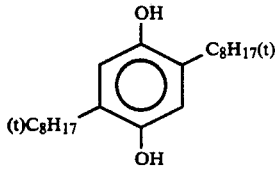
(Cpd-6) Image-dye stabilizer
Mixture (2:4:4 in weight ratio) of
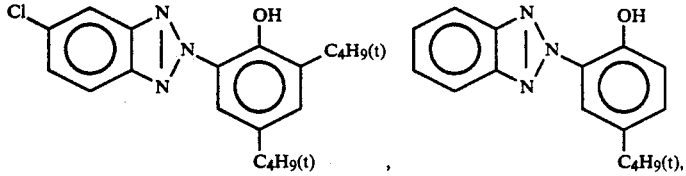

-continued
and 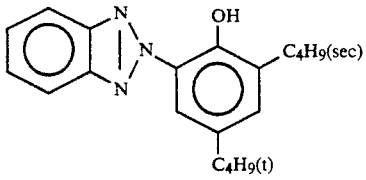
(Cpd-7) Image-dye stabilizer
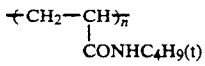
Average molecular weight: 60,000
(Cpd-8) Image-dye stabilizer
Mixture(1:1:1 in weight ratio) of
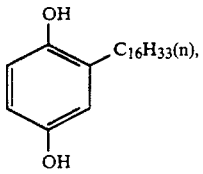
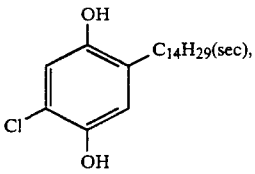
and 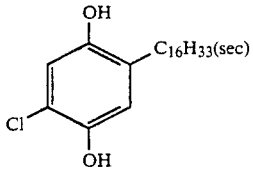
(Cpd-9) Image-dye stabilizer
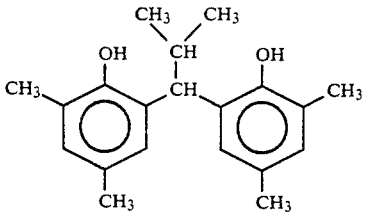
(UV-1) Ultraviolet ray absorber
Mixture (4:2:4 in weight ratio) of
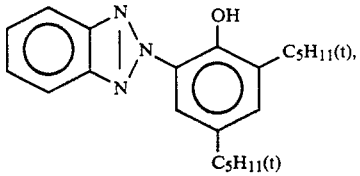
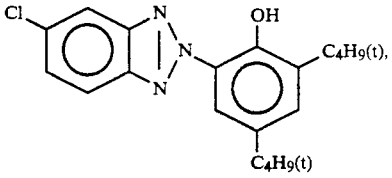
and 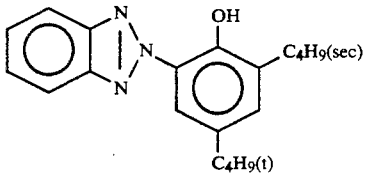
(Solv-1) Solvent
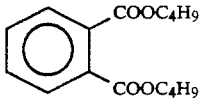
(Solv-2) Solvent
Mixture (2:1 in volume ratio) of -continued

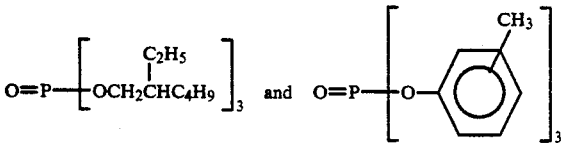

(Solv-4) Solvent

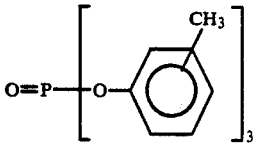

(Solv-5) Solvent

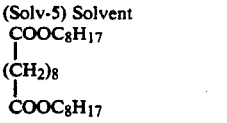

(Solv-6) Solvent

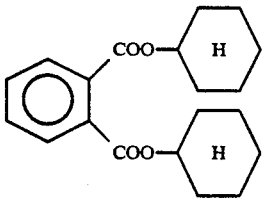

The thus obtained photographic material was designated as A. Photographic materials B, C, D, E, and F were prepared by the same procedure for the preparation of photographic material A, except that only the emulsion of the fifth layer (red-sensitive layer) was changed as shown in Table 1.

In order to investigate the sensitivity and gradation of the thus prepared six photographic materials, they were exposed to light for 0.1 sec through an optical wedge and a red filter, and after 1 hour they were subjected to color development processing by using the processing steps and the processing solutions shown below.

In order to investigate the safelight aptitude of the photographic materials, they were exposed to light for 10 min using a 10-W tungsten lamp placed 1 meter away from the photographic material through a safelight filter 103 A for color paper manufactured by Fuji Photo Film Co., Ltd.; the materials were subjected to wedge exposure for 0.1 sec and were processed in the same way as above.

In order to investigate the latent-image stability of the photographic materials, they were subjected to wedge exposure for 0.1 sec, and after 72 hours they were processed in the same way as above.

| Processing steps | Temperature | Time |
|---|---|---|
| Color Developing | 35° C. | 45 sec. |
| Bleach-fixing | 30–35° C. | 45 sec. |
| Rinsing ① | 30–35° C. | 20 sec. |
| Rinsing ② | 30–35° C. | 20 sec. |
| Rinsing ③ | 30–35° C. | 20 sec. |
| Drying | 70–80° C. | 60 sec. |

The composition of each processing solution was as follows:

| | |
|---|---|
| Color developer | |
| Water | 800 ml |
| Ethylenediamine-N,N,N',N,-tetramethylene phosphonic acid | 1.5 g |
| Potassium bromide | 0.015 g |
| Triethanolamine | 8.0 g |
| Sodium chloride | 1.4 g |
| Potassium carbonate | 25 g |
| N-ethyl-N-(β-methanesulfonamidoethyl)-3-methyl-4-aminoaniline sulfate | 5.0 g |
| N,N-bis(carboxymethyl)hydrazine | 5.5 g |
| Fluorescent whitening agent (WHITEX-4, made by Sumitomo Chemical Ind.) | 1.0 g |
| Water to make | 1000 ml |
| pH (25° C.) | 10.05 |
| Bleach-fixing solution | |
| Water | 400 ml |
| Ammonium thiosulfate (70%) | 120 ml |
| Sodium sulfite | 17 g |
| Iron (III) ammonium ethylenediaminetetraacetate | 55 g |
| Disodium ethylenediaminetetraacetate | 5 g |
| Ammonium bromide | 40 g |
| Water to make | 1000 ml |
| pH (25° C.) | 6.0 |
| Rinsing Solution | |
| Ion-exchanged water (each content of calcium and magnesium was 3 ppm or below) | |

The reflection densities of the processed samples prepared in the above way were measured to obtain the characteristic curves. The sensitivity (S) was given as the reciprocal of the exposure quantity required to give a density 0.5 higher than the fog density, and it was indicated in terms of the relative value with the sensitivity of the photographic material A assumed to be 100. The gradation (G) was indicated by the difference between the density for the exposure quantity increased by 0.5 in terms of log E from the exposure quantity determined for the sensitivity and the density determined for the sensitivity.

As the assessment of the safelight aptitude, the density change ΔD(S) at the time when safelight was shed in the exposure quantity giving a density of 0.5 to the sample upon which safelight was not shed was read. As the assessment of the latent-image stability, the density change ΔD(L) at the time when processed 72 hours after the exposure in the exposure quantity giving a density of 0.5 to the sample processed 1 hour after the exposure was read.

Results are shown in Table 1.

TABLE 1

| Emulsion/-Photo-graphic Material | Localized phase high in silver bromide content | pH at the time when localized phase was formed | pH at the time when chemical sensiti-zation was effected | S[1] | G[2] | ΔD(S)[3] | ΔD(L)[4] | Remarks |
|---|---|---|---|---|---|---|---|---|
| A | absent | — | 6.2 | 100 | 1.27 | 0.01 | −0.04 | Comparative Example |
| B | absent | — | 7.2 | 120 | 1.26 | 0.02 | −0.03 | Comparative Example |
| C | present | 6.2 | 6.2 | 250 | 1.30 | 0.13 | −0.14 | Comparative Example |
| D | present | 6.7 | 6.7 | 320 | 1.36 | 0.06 | −0.06 | This Invention |
| E | present | 7.2 | 7.2 | 420 | 1.44 | 0.02 | −0.01 | This Invention |
| F | present | 7.8 | 7.8 | 370 | 1.40 | 0.03 | −0.03 | This Invention |

[1]Given in terms of the relative value with the sensitivity of photographic material A assumed to be 100. The higher the value is, the higher the sensitivity is.
[2]The higher the value is, harder the gradation is.
[3]The lower the value is, the more excellent safelight aptitude is.
[4]A negative value indicates latent-image regression. The lower the absolute value is, the more excellent the latent-image stability is.

As is apparent from the results shown in Table 1, although emulsions A and B, having no localized phases higher in silver halide content, are excellent in safelight aptitude and latent-image stability, they are low in sensitivity and their gradation is soft, which change little even if the pH at the time when chemical sensitization is effected is set high. In comparison to emulsion A, although emulsion C, having localized phases higher in silver bromide content, is high in sensitivity, the safelight aptitude and the latent-image stability are very poor. Emulsions D, E, and F, wherein the formation of localized phases higher in silver bromide content and the chemical sensitization of the surfaces have been effected at a higher pH, are improved fairly in safelight aptitude and latent-image stability, in addition thereto high sensitivity is attained, and contrast is made high.

Even when the above emulsions were prepared by changing the temperature at which the silver bromide fine grains were added and the sulfur sensitization was effected to 56° C., a great improvement in latent-image stability according to the present invention was confirmed.

EXAMPLE 2

After 32 g of lime-treated gelatin was added to 1000 ml of distilled water and dissolved therein at 40° C., 3.3 g of sodium chloride was added, and then after the pH was set to 6.2 with sodium hydroxide, the temperature was elevated to 50° C. 2.7 ml of N,N'-dimethylimidazolidine-2-thione (1% aqueous solution) was added to the solution. Then a solution of 32.0 g of silver nitrate in 200 ml of distilled water and a solution of 11.0 g of sodium chloride in 200 ml of distilled water were added to and mixed with the solution over 14 min with the temperature kept at 50° C. Further, a solution of 1.6 g of silver nitrate in 60 ml of distilled water and a solution of 1.12 g of potassium bromide in 60 ml of distilled water were added to and mixed with the resulting solution over 10 min with the temperature kept at 50° C. Then a solution of 128.0 g of silver nitrate in 560 ml of distilled water and a solution of 44.0 g of sodium chloride in 560 ml of distilled water were added to and mixed with the solution over 40 min with the temperature kept at 50° C. Thereafter a red-sensitive sensitizing dye (S-1) was added in an amount of $8\times10^{-5}$ per mol of the silver halide. After desalting and washing with water at 40° C. were carried out, 90.0 g of lime-treated gelatin was added and then the pAg and the pH were respectively adjusted with sodium chloride and sodium hydroxide to 7.5 and 6.2. Then sulfur sensitization was optimally effected with triethyl thiourea at 50° C. The thus obtained silver chlorobromide emulsion (containing 1 mol % of silver bromide) was designated as emulsion G.

By the same procedure for the preparation of emulsion G, except that before the sulfur sensitization the pH was adjusted to 7.2 and then sensitization was optimized, a silver chlorobromide emulsion was prepared and was designated as emulsion H.

After 32 g of lime-treated gelatin was added to 1000 ml of distilled water and dissolved therein at 40° C., 3.3 g of sodium chloride was added, and then after the pH was set to 6.2 with sodium hydroxide, the temperature was increased to 50° C. 2.7 ml of N,N'-dimethylimidazolidine-2-thione (1% aqueous solution) was added to the solution. Then a solution of 32.0 g of silver nitrate in 200 ml of distilled water and a solution of 11.0 g of sodium chloride in 200 ml of distilled water were added to and mixed with the solution over 14 min with the temperature kept at 50° C. Further, a solution of 128.0 g of silver nitrate in 560 ml of distilled water and a solution of 44.0 g of sodium chloride in 560 ml of distilled water were added to and mixed with the solution over 40 min with the temperature kept at 50° C. Thereafter a red-sensitive sensitizing dye (S-1) was added in an amount of $8\times10^{-5}$ per mol of the silver halide. Further, a solution of 1.6 g of silver nitrate in 60 ml of distilled water and a solution of 1.12 g of potassium bromide in 60 ml of distilled water were added to and mixed with the resulting solution over 10 min with the temperature kept at 50° C. After desalting and washing with water at 40° C. were carried out, 90.0 g of lime-treated gelatin was added and then the pAg and the pH were respectively adjusted with sodium chloride and sodium hydroxide to 7.5 and 6.2. Then sulfur sensitization was optimally effected with triethyl thiourea at 50° C. The thus obtained silver chlorobromide emulsion (containing 1 mol % of silver bromide) was designated as emulsion I.

By the same procedure for the preparation of emulsion I, except that before the sulfur sensitization the pH was adjusted to 7.2 and then sensitization was optimized, a silver chlorobromide emulsion was prepared and was designated as emulsion J.

After 32 g of lime-treated gelatin was added to 1000 ml of distilled water and dissolved therein at 40° C., 3.3 g of sodium chloride was added, and then after the pH was set to 6.2 with sodium hydroxide, the temperature was elevated to 50° C. 2.7 ml of N,N'-dimethylimidazolidine-2-thione (1% aqueous solution) was added to the solution. Then a solution of 32.0 g of silver nitrate in 200 ml of distilled water and a solution of 11.0 g of sodium chloride in 200 ml of distilled water were added to and mixed with the solution over 14 min with the temperature kept at 50° C. Further, a solution of 128.0 g of silver nitrate in 560 ml of distilled water and a solution of 44.0 g of sodium chloride in 560 ml of distilled water were added to and mixed with the solution over 40 min with the temperature kept at 50° C. Thereafter a red-sensitive sensitizing dye (S-1) was added in an amount of $8\times10^{-5}$ per mol of the silver halide. A silver bromide ultrafine emulsion (having a grain size of 0.05 μm) was added in such an amount that 1.0 mol % of silver bromide was contained for the silver chloride, and after 15 min of ripening, desalting and washing with water at 40° C. were carried out, then 90.0 g of lime-treated gelatin was added and then the pAg and the pH were respectively adjusted with sodium chloride and sodium hydroxide to 7.5 and 6.2. Then sulfur sensitization was optimally effected with triethyl thiourea at 50° C. The thus obtained silver chlorobromide emulsion (containing 1 mol % of silver bromide) was designated as emulsion K.

By the same procedure for the preparation of emulsion K, except that before the sulfur sensitization the pH was adjusted to 7.2 and then the sensitization was optimized, a silver chlorobromide emulsion was prepared and was designated as emulsion L.

All emulsions G to L were cubic grains of grain size 0.50 μm and grain size distribution 0.11.

Electromicrographs of emulsions I, J, K, and L showed that the cubes had corners sharper than those of emulsions G and H. X-ray diffractions of emulsions G, H, I, J, K and L showed weak diffraction at parts wherein the silver bromide content corresponded to 10 to 50 mol %. From the above it can be said that emulsions G and H contain localized phases having a silver bromide content of 10 to 50 mol % inside the grains, and that emulsions I, J, K, and L are ones wherein localized phases having a silver bromide content of 10 to 50 mol % are grown epitaxially on the corners of cubic silver chloride grains.

Photographic materials G, H, I, J, K, and L were prepared by the same procedure for the preparation of photographic material A of Example 1, except that only the emulsion of the fifth layer (red-sensitive layer) was changed as shown in Table 2.

The sensitivity, gradation, safelight aptitude, and the latent-image stability of the thus obtained six photographic materials were assessed in a similar manner to Example 1. The results are shown in Table 2.

TABLE 2

| Emulsion/-Photo-graphic Material | Localized phase high in silver bromide content | pH at the time when localized phase was formed | pH at the time when chemical sensiti-zation was effected | S[1] | G[2] | ΔD(S)[3] | ΔD(L)[4] | Remarks |
|---|---|---|---|---|---|---|---|---|
| G | Inside a grain | 6.2 | 6.2 | 100 | 1.20 | 0.10 | −0.16 | Comparative Example |
| H | Inside a grain | 6.2 | 7.2 | 135 | 1.22 | 0.09 | −0.15 | Comparative Example |
| I | Grain surface | 6.2 | 6.2 | 180 | 1.26 | 0.15 | −0.13 | Comparative Example |
| J | Grain surface | 6.2 | 7.2 | 240 | 1.36 | 0.05 | −0.04 | This Invention |
| K | Grain surface | 6.2 | 6.2 | 190 | 1.27 | 0.10 | −0.12 | Comparative Example |
| L | Grain surface | 6.2 | 7.2 | 300 | 1.40 | 0.01 | −0.02 | This Invention |

[1]Given in terms of the relative value with the sensitivity of photographic material A assumed to be 100. The higher the value is, the higher the sensitivity is.
[2]The higher the value is, harder the gradation is.
[3]The lower the value is, the more excellent safelight aptitude is.
[4]A negative value indicates latent-image regression. The lower the absolute value is, the more excellent the latent-image stability is.

As is apparent from the results shown in Table 2, when emulsions G and H, wherein localized phases higher in silver bromide content are contained inside the grains are compared, the effect of pH at the time of chemical sensitization on sensitivity, gradation, safelight aptitude, and latent-image stability is very small. When emulsions I and J and emulsions K and L, having localized phases higher in silver bromide content near the grain surfaces are compared, in emulsions J and L, whose chemical sensitization has been effected at a relatively high pH, the safelight aptitude and the latent-image stability are greatly improved and high sensitivity and hard gradation are achieved. The effect is remarkable in emulsion L, wherein silver bromide ultrafine grains are added to form localized phases higher in silver bromide content near the grain surfaces.

EXAMPLE 3

After 32 g of lime-treated gelatin was added to 1000 ml of distilled water and dissolved therein at 40° C., 1.6 g of sodium chloride was added to the solution and the temperature was elevated to 54° C. 1.7 ml of N,N'-dimethylimidazolidine-2-thione (1% aqueous solution) was added to the resulting solution. Then a solution of 32.0 g of silver nitrate in 200 ml of distilled water and a solution of 11.0 g of sodium chloride in 200 ml of distilled water were added to and mixed with the solution over 14 min with the temperature kept at 54° C. Further, a solution of 128.0 g of silver nitrate in 560 ml of distilled water and a solution of 44.0 g of sodium chloride in 560 ml of distilled water were added and mixed with the obtained solution over 40 min with the temperature kept at 54° C. After desalting and washing with water at 40° C. were effected, 90.0 g of lime-treated gelatin was added thereto, and with sodium chloride and sodium hydroxide the pAg and the pH were respectively adjusted to 8.1 and 6.0. Then, after the temperature was increased to 46° C., a red-sensitive sensitizing dye (S-1) was added in an amount of $8\times10^{-5}$ mol per mol of the silver halide. Then a silver bromide ultrafine emulsion (having a grain size of 0.05 μm) was added in such an amount that 0.55 mol % of silver bromide was contained for the silver chloride, and after 25 min of ripening, sulfur sensitization was optimally effected with triethyl urea at 46° C. The thus obtained silver chlorobromide emulsion (containing 0.55 mol % of silver bromide) was designated as emulsion M.

By the same procedure for the preparation of emulsion M, except that after the addition of the silver bromide ultrafine emulsion and the ripening, and before the sulfur sensitization, the pH was adjusted to 7.3 with sodium hydroxide and then sensitization was optimized, a silver chlorobromide emulsion was prepared and was designated as emulsion N.

By the same procedure for the preparation of emulsion M, except that before the addition of the silver bromide ultrafine emulsion the pH was adjusted to 7.3 with sodium hydroxide, then immediately before the start of the sulfur sensitization the pH was adjusted to 6.0 with sulfuric acid and then sensitization was optimized, a silver chlorobromide emulsion was prepared and was designated as emulsion O.

By the same procedure for the preparation of emulsion M, except that before the addition of the silver bromide ultrafine emulsion the pH was adjusted to 7.3 and then the sensitization was optimized, a silver chlorobromide emulsion was prepared and was designated as emulsion P.

By the same procedure for the preparation of emulsion M, except that before the addition of the silver bromide ultrafine emulsion, potassium hexachloroiridate(IV) was contained in the sulfur sensitization in an amount of $1.1\times10^{-5}$ mol per mol of silver bromide and sensitization was optimized, a silver chlorobromide emulsion was prepared and was designated as emulsion Q.

By the same procedure for the preparation of emulsion P, except that before the sulfur sensitization, potassiumhexachloroiridate(IV) was contained in the silver bromide ultrafine emulsion in an amount of $1.1\times10^{-5}$ mol per mol of silver bromide and sensitization was optimized, a silver chlorobromide emulsion was prepared and was designated as emulsion R.

The six emulsions M to R were cubic grains of grain size 0.52 μm and grain size distribution 0.10.

Electromicrographs of emulsions M, N, O, P, Q, and R showed that the corners of the cubes were sharp. X-ray diffractions of these emulsions showed weak diffraction at parts wherein the silver bromide content corresponded to 10 to 50 mol %. From the above it can be said that these emulsions are ones wherein localized phases having a silver bromide content of 10 to 50 mol % are grown epitaxially on the corners of cubic silver chloride grains.

Photographic materials M, N, O, P, Q, and R were prepared by the same procedure for the preparation of photographic material A of Example 1, except that only the emulsion of the fifth layer (red-sensitive layer) was changed as shown in Table 3.

The sensitivity, gradation, safelight safety property, and the latent-image-keeping property of the thus obtained six photographic materials were assessed in a similar manner to Example 1. The results are shown in Table 3.

TABLE 3

| Emulsion/-Photo-graphic Material | Iridium | pH at the time when localized phase was formed | pH at the time when chemical sensiti-zation was effected | S[1] | G[2] | ΔD(S)[3] | ΔD(L)[4] | Remarks |
|---|---|---|---|---|---|---|---|---|
| M | None | 6.0 | 6.0 | 100 | 1.25 | 0.12 | −0.13 | Comparative Example |
| N | None | 6.0 | 7.3 | 150 | 1.36 | 0.06 | −0.05 | This Invention |
| O | None | 7.3 | 6.0 | 155 | 1.36 | 0.05 | −0.03 | This Invention |
| P | None | 7.3 | 7.3 | 160 | 1.41 | 0.02 | −0.02 | This Invention |
| Q | Contained in localized phase | 6.0 | 6.0 | 120 | 1.38 | 0.25 | −0.12 | Comparative Example |
| R | Contained in localized phase | 7.3 | | 190 | 1.48 | 0.02 | −0.01 | This Invention |

[1]Given in terms of the relative value with the sensitivity of photographic material A assumed to be 100. The higher the value is, the higher the sensitivity is.
[2]The higher the value is, harder the gradation is.
[3]The lower the value is, the more excellent safelight aptitude is.
[4]A negative value indicates latent-image regression. The lower the absolute value is, the more excellent the latent-image stability is.

As is apparent from the results shown in Table 3, if the ripening in a condition having a pH of 6.5 or over is effected only when localized phases higher in silver bromide content are formed or only when the surfaces are chemically sensitized, the effect of the present invention can be obtained, although the effect of the present invention is particularly remarkable when a condition having a pH of 6.5 or over is retained both at the time of the formation of localized phases higher in silver bromide content and at the time of the chemical sensitization of the surfaces. Although by forming localized phases higher in silver bromide content in the presence of an iridium compound, emulsions whose gradation is hard even at high-illumination intensity exposure can be obtained, as in the experiments, the safelight aptitude are considerably deteriorated. It can be understood that the effect of the present invention is particularly remarkable in emulsion R of the present invention, which contains an iridium compound.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for producing a silver halide emulsion of silver chlorobromide, 95 mol % or more of which is made up of silver chloride, and which is substantially free from silver iodide, said method comprising forming, on or near the surfaces of silver halide grains, localized phases having a silver bromide content of at least 10 mol %, and then by chemically sensitizing the resulting surfaces, and ripening the silver chlorobromide emulsion at a pH of 6.5 or more during at least part of the formation stage of said localized phases, during at least part of the stage of chemical sensitization of the surfaces, or during both at least part of the formation stage of said localized phases and at least part of the stage of chemical sensitization of the surfaces.

2. A method according to claim 1, wherein said silver chlorobromide emulsion is ripened at a pH of 6.8 to 8.0 during at least part of the formation stage of said localized phases, during at least part of the stage of chemical sensitization of the surfaces, or during both at least part of the formation stage of said localized phases and at least part of the stage of chemical sensitization of the surfaces.

3. A method according to claim 2, wherein said silver chlorobromide emulsion is ripened at a pH of 7.0 to 7.7 during at least part of the formation stage of said localized phases, during at least part of the stage of chemical sensitization of the surfaces, or during both at least part of the formation stage of said localized phases and at least part of the stage of chemical sensitization of the surfaces.

4. A method according to claim 1, wherein said silver chlorobromide emulsion is ripened at a pH of 6.5 or more during both at least part of the formation stage of said localized phases and at least part of the stage of chemical sensitization of the surfaces.

5. A method according to claim 1, wherein said silver chlorobromide emulsion is ripened under the condition wherein a pH of 6.5 or over is maintained at the time of the formation of said localized phases.

6. A method according to claim 1, wherein said silver chlorobromide emulsion is ripened under the condition wherein a pH of 6.5 or more is maintained at the time of chemical sensitization of the surfaces.

7. A method according to claim 1, wherein said silver chlorobromide emulsion is ripened under the condition wherein a pH of 6.5 or more is maintained at the time of the formation of localized phases and at the time of chemical sensitization of the surfaces.

8. A method according to claim 1, wherein said localized phases are formed by mixing cubic or tetradecahedral silver halide host grains with silver halide fine grains that have an average grain diameter smaller than said silver halide host grains and that are higher in silver bromide content than said silver halide host grains, and then by ripening.

9. A method according to claim 1, wherein the formation of said localized phases is carried out in the presence of an iridium compound.

10. A method according to claim 1, wherein said localized phases are ripened under the condition of having a pH in the range of 7.0 to 7.7 from the start of the formation of said localized phases to the completion of the chemical sensitization of the surfaces.

11. A method according to claim 1, wherein the content of silver chloride of said silver chlorobromide emulsion is 98 mol % or more.

12. A method according to claim 1, wherein the content of silver bromide of said localized phases higher in silver bromide content is in the range of 10 mol % to 60 mol %.

13. A method according to claim 1, wherein said localized phases higher in silver bromide content contain 0.1 to 20% of all silver constituting silver halide grains.

14. A method according to claim 1, wherein sulfur sensitization is carried out as the chemical sensitization.

15. A method according to claim 1, wherein the average grain diameter of the silver halide grains is in the range of 0.1 to 1.5 μm.

* * * * *